US005886470A

United States Patent [19]

Smolka

[11] Patent Number: 5,886,470

[45] Date of Patent: Mar. 23, 1999

[54] DISCHARGE LAMP WHICH HAS A FILL OF AT LEAST ONE OF DEUTERIUM, HYDROGEN, MERCURY, A METAL HALIDE, OR A NOBLE GAS

[75] Inventor: Ernst Smolka, Speyer, Germany

[73] Assignee: Heraeus Noblelight GmbH, Hanau, Germany

[21] Appl. No.: 895,349

[22] Filed: Jul. 16, 1997

[30] Foreign Application Priority Data

Jul. 18, 1996 [DE] Germany ..... 196 28 925.4

[51] Int. Cl.[6] ..... H01J 61/10

[52] U.S. Cl. ..... 313/637; 313/609; 313/610; 313/638

[58] Field of Search ..... 313/637, 609, 313/610, 611, 612, 581, 638–641

[56] References Cited

U.S. PATENT DOCUMENTS

| | | | |
|---|---|---|---|
| 3,501,665 | 3/1970 | Rotger et al. . | |
| 3,508,106 | 4/1970 | Vecsernyes . | |
| 3,848,150 | 11/1974 | Taxil et al. | 313/610 |
| 4,816,719 | 3/1989 | Maya et al. | 313/610 |
| 4,884,007 | 11/1989 | Lagushenko et al. . | |
| 5,327,049 | 7/1994 | Smolka et al. . | |

FOREIGN PATENT DOCUMENTS

| | | |
|---|---|---|
| 0 473 378 A2 | 3/1992 | European Pat. Off. . |
| 0 685 874 A1 | 12/1995 | European Pat. Off. . |
| 1 042 115 | 10/1958 | Germany . |
| 39 08 553 C1 | 3/1989 | Germany . |
| 06-310101 A | 11/1994 | Japan . |
| 1051920 | 12/1966 | United Kingdom . |
| 1214179 | 12/1970 | United Kingdom . |

*Primary Examiner*—Nimeshkumar D. Patel
*Attorney, Agent, or Firm*—Frishauf, Holtz, Goodman, Langer & Chick, P.C.

[57] ABSTRACT

To increase the radiation output from a discharge lamp having a diaphragm arrangement located between an anode (3) and a heatable cathode (4), the diaphragm arrangement constricts the radiation discharge path along an axis (5, 105) extending through the diaphragm opening and towards the anode (3, 103), and has a dimension along the length of said axis of at least 0.3 mm. The diaphragm arrangement can be formed by a plurality, preferably about 3 diaphragm elements (6, 7, 8), each having diaphragm openings of from between 0.1 to 2 mm, made of sheet metal of a thickness of at least 0.03 mm, and preferably of between 0.1 to 1 mm, and in which the spacing of the diaphragm openings (10, 11, 12) with respect to each other is in the range of about 0.1 to 5 mm, preferably about 0.3 mm; alternatively, the diaphragm arrangement may include one massive diaphragm having an axial thickness of between 1 and 50 mm, preferably between about 1 and 5 mm, and spaced from the anode by between about 0.5 and 2 mm, with a diaphragm diameter (113) between about 0.1 and 2 mm.

20 Claims, 3 Drawing Sheets

DISCHARGE LAMP WHICH HAS A FILL OF AT LEAST ONE OF DEUTERIUM, HYDROGEN, MERCURY, A METAL HALIDE, OR A NOBLE GAS

FIELD OF THE INVENTION

The present invention relates to a discharge lamp which has a bulb retaining a fill of at least one of deuterium, hydrogen, mercury, a metal halide, or a noble gas. The lamp bulb is made of quartz glass or a high silicate glass or another UV radiation transmitting material, and retains a support structure which has an anode and a cathode and at least one diaphragm of a high temperature resistant, high melting point material such as, for example, tungsten. The diaphragm is formed with an opening to constrict an arc discharge between the electrodes located in the bulb.

BACKGROUND

German 39 08 553 C1, Thomas et al., describes a gas discharge lamp which includes a fill of deuterium or hydrogen within a cylindrical bulb made of quartz glass. A support structure supports an anode and a cathode. A diaphragm is located in the housing to constrict a discharge or arc between the electrodes. The cathode is located outside of, or laterally of an axis defined by the radiation path through the opening of the diaphragm. The structure supporting the anode and cathode is formed with a window, similar to a diaphragm opening, removed or cut from the material of the structure to provide for shielding of cathode emitter material. Only a single diaphragm is possible because of the arrangement of the structure; consequently, only a single plasma region can be obtained.

U.S. Pat. No. 5,327,049, Smolka et al., relates to an electrodeless discharge lamp with an apertured diaphragm body therein.

THE INVENTION

It is an object to increase the intensity of the radiation emitted by the lamp and, especially, to increase the usable radiation density of a deuterium lamp, a hydrogen discharge lamp, a mercury vapor lamp, or a discharge lamp having a noble gas therein.

Briefly, the discharge lamp has a diaphragm arrangement or a diaphragm means which is so constructed that it concentrates the radiation discharge along a radiation axis between the diaphragm opening and the anode by carefully controlling the axial dimension of the diaphragm arrangement, or means, along the radiation axis. This dimension can be obtained by utilizing, for example, at least two diaphragm elements, made of sheet metal of a thickness of at least 0.03 mm, and spacing these two diaphragms such that the apertures of the respective diaphragm elements are spaced from each other by at least 0.1 mm. Alternatively, the diaphragm means is a single diaphragm element which, at least in the region surrounding the diaphragm aperture, has a thickness along the radiation axis of from between 1 to 50 mm, and preferably between about 1 and 5 mm.

A lamp with the diaphragm arrangement dimensioned as aforesaid has the particular advantage that the density of radiation, and overall radiation, is substantially increased because a plurality of plasma balls can be formed; the additional cost, above prior art lamps, is small, particularly if a plurality of diaphragm elements are used. Likewise, the massive construction with a single massive diaphragm element is easily made and assembled.

In accordance with a preferred feature of the invention, the diaphragm elements are made of a metallic material which is high temperature resistant, and has a high melting point. If a plurality of diaphragm elements are used, they are electrically insulated with respect to each other. The fill gas, preferably, is deuterium. It is also possible, however, to use a fill of hydrogen, or a noble gas as, for example, xenon; or to use mercury or metal halides, respectively. The detailed description will be directed to a lamp particularly suitable for use with a deuterium fill.

Due to the radiation mechanism of deuterium, the deuterium continuum is optically thin or transparent, that is, there is practically no re-absorption of emitted radiation in a second or third plasma, if sequential diaphragm elements are used in the lamp. There is little $D_2$ depletion. This is a substantial advantage, and use of two or multiple diaphragm elements permit obtaining a substantial multiple of intensity with respect to the prior art. This is especially so if, for example, three diaphragm elements are used. The diaphragms form auxiliary electrodes.

When using multiple diaphragm elements, it is particularly desirable to interconnect the diaphragm elements in selected arrangement, which can be switchable, as follows:

(1) The diaphragms are interconnected electrically.

(2) The diaphragms are electrically insulated with respect to each other.

(3) The diaphragms are connected over a resistor or resistors to improve ignition.

(4) Anode voltage is sequentially switched from diaphragm element to diaphragm element to obtain ignition and reliably ensure ignition.

In accordance with a preferred embodiment, three diaphragms are used which are connected to different voltage taps of a resistor chain which is connected to the anode. Alternatively, the diaphragm elements are each connected through a controllable switch to the supply voltage of the electrodes, the switches sequentially connecting the diaphragms starting from the one closest to the cathode to the anode voltage. The diaphragms, then, can take over the task of auxiliary anodes during the ignition phase. Stepped ignition, thus, of a deuterium lamp is made possible, which improves the reliability of ignition.

It is a specific advantage of a multiple-diaphragm lamp with the dimensions noted above that the radiation density is substantially increased by widening the formation of plasma along the radiation axis, while requiring only a very simple construction.

The opening in the diaphragms may have a dimension of between 0.1 and 2 mm. The diaphragms themselves may be made of tungsten, molybdenum, or a high melting point ceramic, such as for example aluminum nitride. Diaphragms made of ceramic material can be formed with an electrically conductive surface which itself may be of a resistance material or connected to suitable switches.

DRAWINGS

FIG. 1*a* is a highly schematic vertical view through a deuterium lamp having three diaphragms located along an optical axis;

FIG. 1*b* is an enlarged view of the portion of the lamp of FIG. 1*a* within the circle Z;

FIG. 1*c* is a cross section of the lamp along the section line A-B of FIG. 1*a*;

FIG. 1*d* is a vertical view similar to FIG. 1*a*, but rotated with respect to FIG. 1*a* by 90°;

FIG. 1*e* is an electrical circuit diagram showing connection of the electrodes and the diaphragms, in which the anode and the diaphragms are connected by resistors or resistance elements;

FIG. 1*f* is an electrical circuit in which the anodes and the diaphragms are connected over controlled switches to a current supply;

FIG. 2*a* is a highly schematic vertical view of a deuterium lamp having a diaphragm element with a thickness of between about 1 and 50 mm, and an opening along the optical axis of the radiation path;

FIG. 2*b* is a highly schematic, greatly enlarged portion of the lamp of FIG. 2*a* within the circle Z of FIG. 2*a;*

FIG. 2*c* is a cross section through the lamp of FIG. 2*a*, as well as of the portion shown in FIG. 2*b*, along section line A-B;

FIG. 2*d* is a view similar to FIG. 2*a*, but rotated with respect to FIG. 1*a* by 90°; and FIG. 2*e* is a highly schematic circuit of the lamp, including the connections to the diaphragm and the electrodes.

DETAILED DESCRIPTION

Figure 1A:
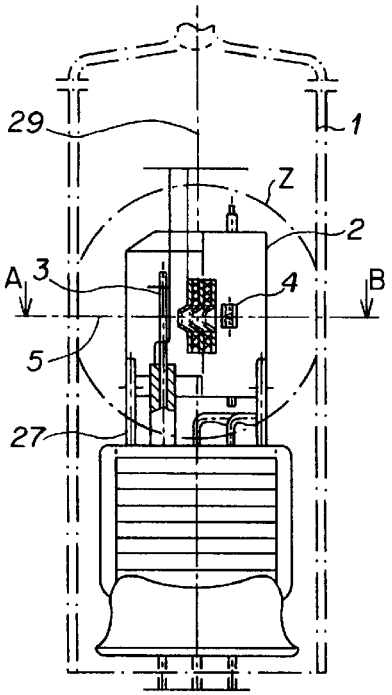

Two embodiments of the invention will be described in detail, the first embodiment being illustrated in FIGS. 1*a* to 1*e*, and the second embodiment in FIGS. 2*a* to 2*c*. Reference numerals in the second embodiment, which describe parts already described in connection with FIG. 1 (collectively), are incremented by 100 with respect to the previously used reference numerals.

Figure 1B:
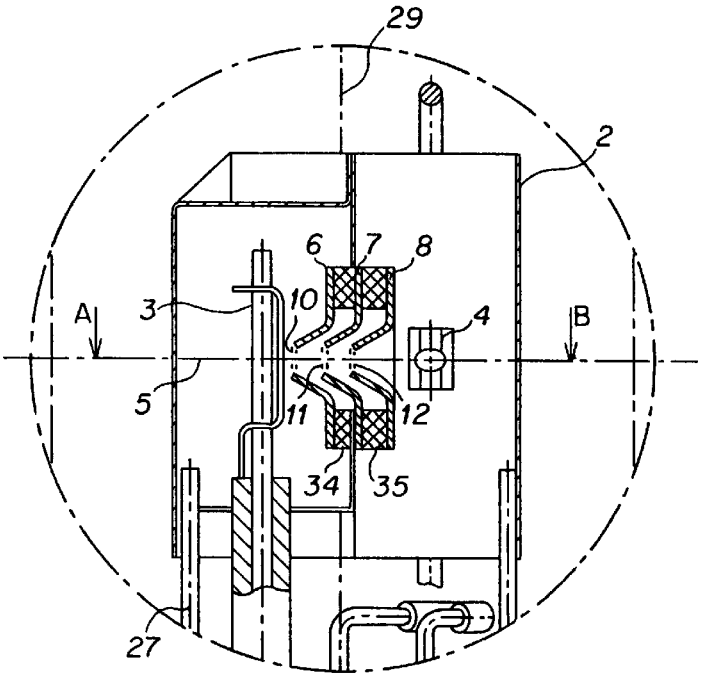

Referring first to FIG. 1—collectively (FIGS. 1*a*–1*f*), and specifically to FIGS. 1*a* and 1*b;*

The lamp is a deuterium lamp which has a bulb 1 made of quartz glass, within which a structure 2 forming a housing 1 is located. Structure 2 supports a plate-shaped anode 3 and a heatable cathode 4. Three diaphragms 6, 7 and 8 are located close to the anode, and aligned along an axis 5 of radiation emission. The diaphragms or diaphragm elements 6, 7 and 8 are made of high melting point material, and are funnel-shaped and, to increase the intensity of the radiation, cause constriction of the discharge along the axis 5. The openings 10, 11, 12 constrict this discharge. The bulb 1 has a vertical axis 29, axis 5 being transverse to said vertical axis.

Figure 1D:
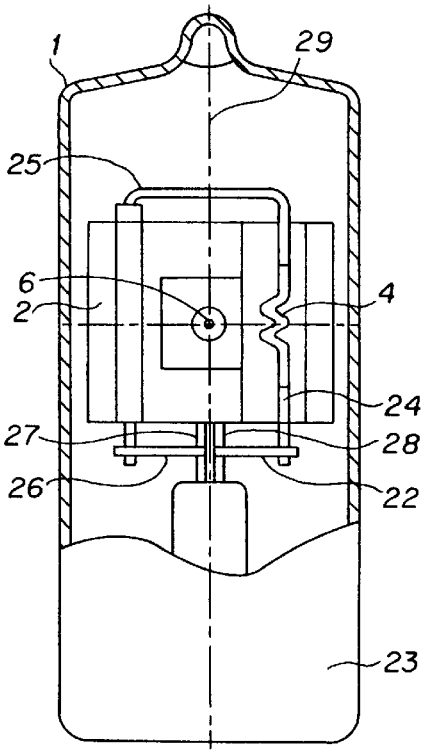
Figure 1C:
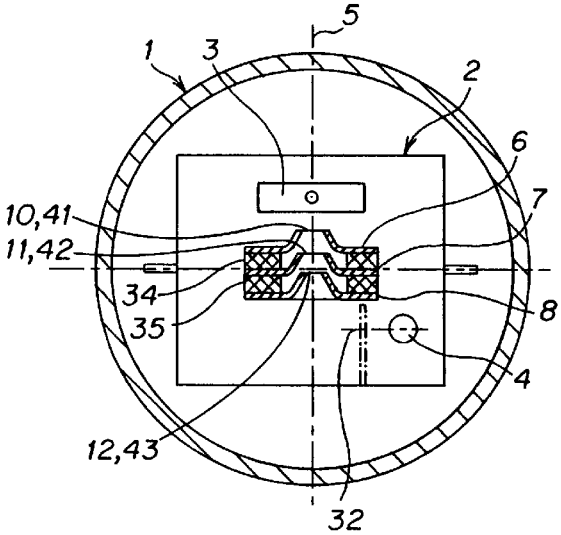

The detail view of FIG. 1*c*, that is a cross section along line A-B of FIGS. 1*a* and 1*b*, shows that the anode is intersected by the axis 5, which axis defines the light emission direction. The cathode 4 is located laterally of this axis in order to permit free emission of radiation from the axis 5. In normal operation, the openings 10, 11, 12 of the diaphragms 6, 7, 8 each form a plasma ball 41, 42, 43, shown only schematically in FIG. 1*c*. A window 32 in form of a diaphragm opening is located between the cathode 4 and the axis 5. Cathode emitter material is thus shielded.

In accordance with FIG. 1*c*, the diaphragm elements 6, 7, 8 are electrically insulated from each other, and also electrically insulated with respect to the structure or housing 2.

Current is supplied as best seen in FIG. 1*d*, and similar to the above-described patent disclosure of German 39 08 553 C1, Thomas et al., through a current supply line 22 which is connected within the base 23 to a contact bolt 24 which, in turn, is connected to the cathode. The connection continues through a return line in form of a connecting bail-shaped portion 25 and a connecting line 26 which also leads into the base 23. The base structure is conventional. Thus, a closed loop for heating the cathode is formed. Connection leads 27, 28 are connected to the anode and to the housing 2, and similar leads are connected to lines 22, 26, and then to suitable base terminals.

In accordance with a feature of the invention, the diaphragms 6, 7, 8, made of sheet metal, have a thickness of at least 0.03 mm, and, in the example, between about 0.1 to 1 mm. The spacing along the axis 5 of the diaphragm openings 10, 11, 12 of diaphragm elements 5, 6, 7, with respect to each other, is in the range of about 0.1 to 1.0 mm, and preferably about 0.3 mm. The diaphragm elements form auxiliary electrodes. Ring-shaped spacers 34, 35, for example of ceramic material, can be located between adjacent spacer elements 6, 7 and 7, 8. The spacer elements 34, 35 may have an electrically insulated surface. Alternatively, the spacer elements are formed either as resistance elements, for example ceramic resistance elements, or of insulating material with a resistive surface coating.

Figure 1E:
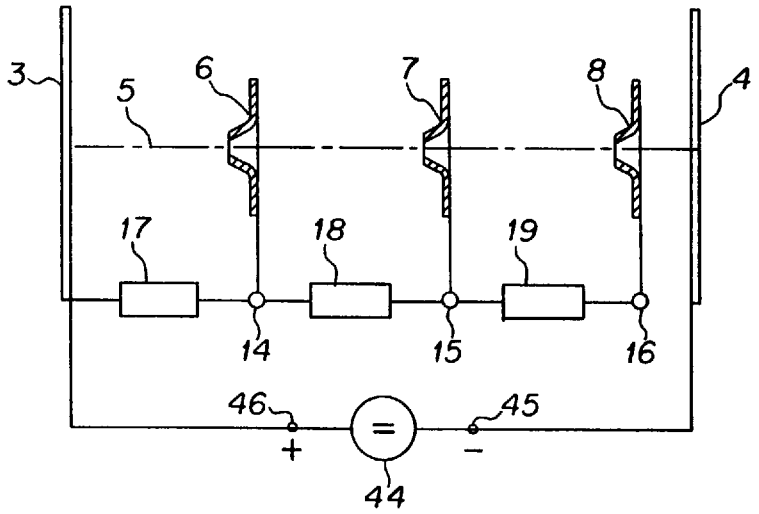

The electrical connection of diaphragms 6, 7, 8 is best seen in one embodiment in FIG. 1*e*. The diaphragm elements 6, 7, 8 are made of metal and are connected to tap points 14, 15, 16 of a voltage divider or resistance chain made of resistors 17, 18, 19. When the lamp is not ignited, all the diaphragms are at anode voltage. Anode 3 and the voltage dividers formed by resistors 17, 18, 19 are connected to the positive terminal 48 of a d-c source 44; the cathode 4 is connected to the negative terminal 45. The diaphragms 6, 7, 8 form auxiliary electrodes, here anodes. Upon ignition and formation of the discharge between cathode 4 and the first diaphragm 8, a limited current will flow through resistor 19. The voltage drop results in a drop in voltage of the diaphragm 8 with respect to diaphragm 7, which in turn results in a discharge through and to the second diaphragm, that is, diaphragm 7. The diaphragm 7 now takes over the function of an auxiliary anode, resulting in ignition through the first diaphragm 8 and to the diaphragm 7. This sequential ignition or stepwise ignition continues until all three diaphragms 6, 7, 8 have functional as auxiliary anodes.

The spacing between the diaphragms 6, 7, 8, shown only schematically in FIG. 1*e*, is between about 0.5 to 2 mm. Preferably, the spacing between the diaphragms is at least approximately the same as the diameter of the aperture of the diaphragm. The thickness of the diaphragm material is preferably less than ½ mm, for example, about 0.3 mm. Molybdenum is particularly suitable for making the diaphragms; it is, of course, also possible to make them of a material such as tungsten or a tungsten alloy, or a high melting point ceramic, such as aluminum nitride. Diaphragms of electrically insulating materials can be coated with an electrically conductive coating, for example of nickel, tungsten or molybdenum, to obtain electrical conductivity.

Operating a lamp as shown specifically in FIGS. 1*a*–1*d* as above described results in a substantial multiplication of radiation density since the radiation derived from plasma regions in the arrangement shown will not interfere with each other, but becomes cumulative, so that a substantial increase in emitted radiation density is obtained.

Figure 1F:
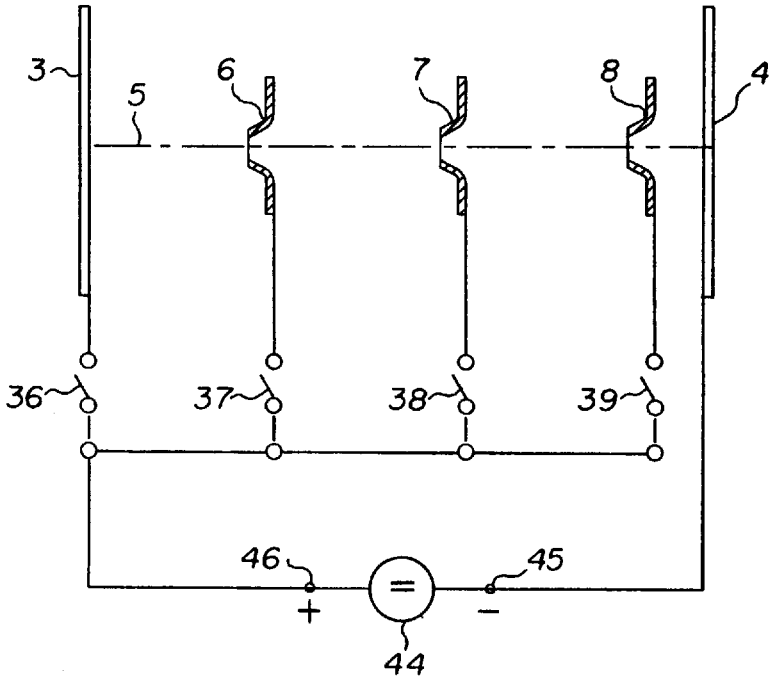

Another way to obtain sequential ignition is shown in FIG. 1*f*, in which the anode 3 and diaphragms 6, 7, 8 are selectively connected to anode potential by controlled switches 36, 37, 38, 39. The cathode 4 is continuously connected to the negative terminal 45 of the d-c source 44. The positive terminal 46, to ensure reliable ignition, is first connected over the controlled switch 39 to the diaphragm closest to the cathode 4, that is, diaphragm 8, to form an arc discharge between the cathode 4 and diaphragm 8. Next, switch 38 is closed and switch 39 is opened, so that diaphragm 7 is now place at anode voltage, and the arc will extend to diaphragm 7. Next, switch 37 is closed and switch 38 is opened, so that diaphragm 6 will take over anode voltage, and diaphragms 7 and 8 will continue to carry the discharge. After closing of the controlled switch 36, switch 37 is opened, and the arc will extend to the anode 3, so that a continuous arc discharge between cathode 4 and anode 3 will result, all three diaphragms 6, 7, 8 carrying the discharge and passing it through the respective apertures.

The switches are shown only schematically, and the dimensions are highly exaggerated for ease of illustration.

FIG. 2 (collectively) illustrates another embodiment in which a quartz-glass bulb 101 retains a support structure or housing 102 therein, including a plate-shaped anode 103 and a heatable cathode 104. The axis 105 of radiation discharge is defined by the anode 103 and an immediately adjacent diaphragm body 109, made of high melting point material. The diaphragm body or diaphragm element 109 is formed with a diaphragm opening 113. A similar diaphragm body as such is described in the referenced U.S. Pat. No. 5,327,049, Smolka et al.

Figure 2A:
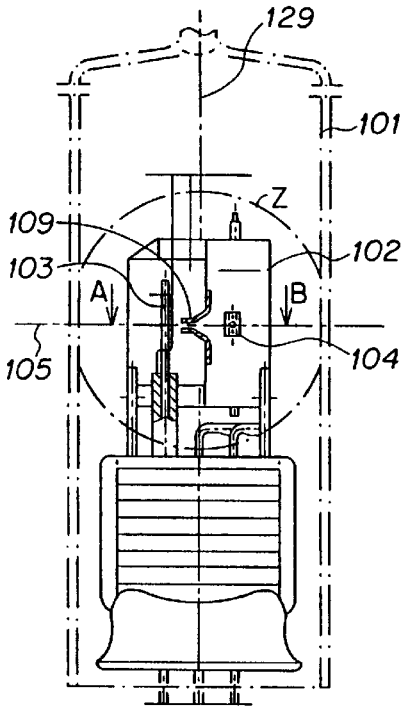
Figure 2B:
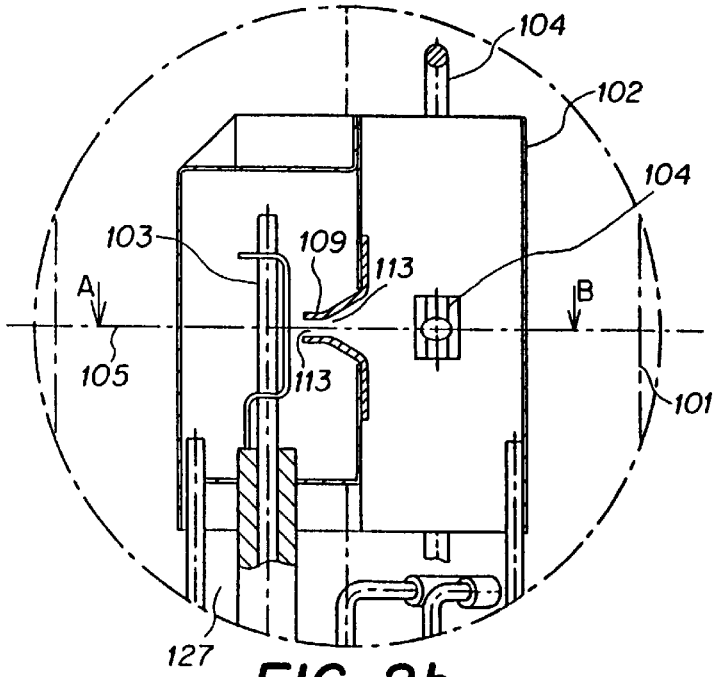
Figure 2C:
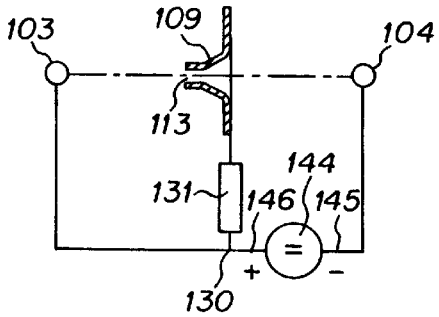

FIG. 2*c* illustrates the electrical connection of the diaphragm element 109, namely through a resistor 131 to a junction 130 between the anode 103 and the anode connection forming the positive terminal 146 of a d-c source 144. The cathode 104 is connected to the negative terminal 145 of source 144. Upon energization of the circuit, for example by closing a master switch, diaphragm element 109 is at anode voltage before an arc is struck. The diaphragm element 109 forms an auxiliary anode. Upon ignition of a discharge between the cathode 104, connected to the negative terminal 145 of the d-c source 144, current will flow to the diaphragm element 109; this current is limited by the resistor 131. The voltage drop across the resistor results in a decrease in voltage at the diaphragm 109 with respect to the anode 103, which is used to ignite the discharge through the opening 113 of the diaphragm 109. The diaphragm 109, thus, takes over the function of an auxiliary anode.

It is of course possible to also control ignition by a controllable switch, rather than using a resistor 131, or also in connection therewith. In that case, the diaphragm body 109 must be electrically insulated with respect to the anode 103.

The spacing between the diaphragm body 109 to the anode 3 is between about 0.5 to 2 mm, and preferably is about twice the diameter of the opening of the diaphragm, so that connection or contacting of the plasma ball within the body of the diaphragm element 109 with the anode 103 is prevented. The thickness of the diaphragm along the axis 109 is between about 1 and 5 mm, and preferably between about 1 and 5 mm. The diaphragm element, or body 109 is suitably and preferably made of molybdenum. It is, of course, equally possible to sue tungsten or a tungsten alloy, or a high melting point ceramic, such as aluminum nitride. If electrically insulating ceramic materials are used for the diaphragm element, or body 109, a high temperature resistant electrically conductive coating, for example of nickel, tungsten or molybdenum, should be applied to the ceramic.

In operation, a multiplication of the density of radiation obtained with prior art lamps is possible. This radiation is emitted along the optical axis 105; radiation portions from individual plasma regions along the optical axis 105 do not interfere with each other but, rather, tend to increase the density of radiation.

Ignition in accordance with this embodiment is possible in two steps:

Step 1: Ignition between cathode 4 and diaphragm element 109, the diaphragm element 109 initially forming an auxiliary anode; and Step 2: Ignition between cathode 104 and anode 103; the diaphragm element 109 preferably is then disconnected from the circuit and insulated with respect to the housing or structure 102, and is voltage-free. If the resistor 131 is used, or retained in the circuit by not being disconnected by a controlled switch, the voltage drop through the resistor should be substantial so that its voltage will be substantially below that of the anode.

Figure 2E:
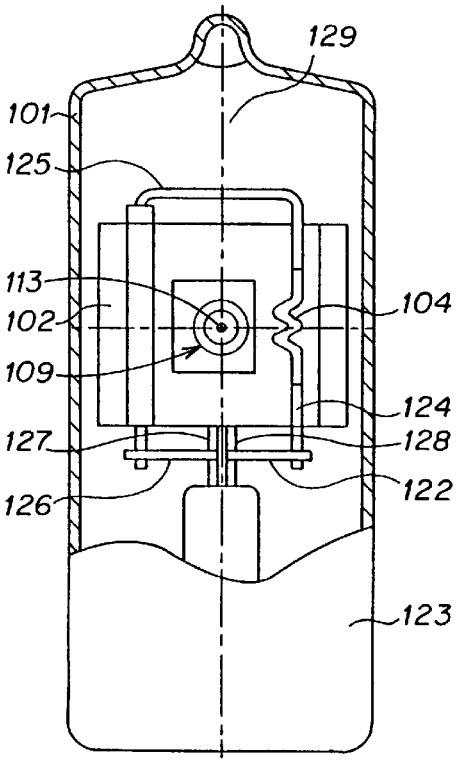
Figure 2D:
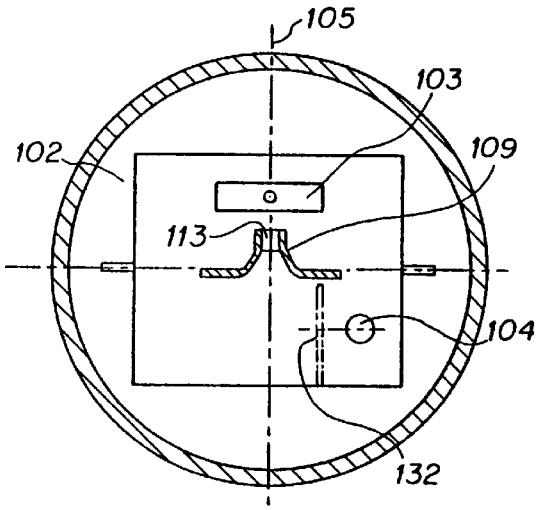

FIG. 2*d* is a cross section along the line A-B of FIGS. 2*a* and 2*b*. As can be seen, the cathode 104 is located laterally of the axis 105 of light emission, whereas anode 103 is intersected by axis 105. In normal operation, a plasma region will form in the opening 113 of the diaphragm element 109, shown only schematically in FIG. 2*d*. A diaphragm-like window 132, to shield with respect to cathode material, is located between the cathode 104 and the radiation axis 105. This is best seen in FIG. 2*d*.

As seen in FIG. 2*d*, the diaphragm element 109 is electrically insulated with respect to the structure or housing 102.

Current supply to the diaphragm 109 is seen in FIG. 2*e*, and similar to the current supply previously explained with respect to FIG. 1*e*. The cathode 104 is connected to a contact bolt 124 which, in turn, is connected through a connection line 122 leading into the base which, otherwise, is of suitable construction and has the required base terminals. A bail-shaped connecting element 125 is connected to the cathode 104 and, further, to a line 126, to form a closed heating circuit for the cathode. Connections for the lines 122, 126 leading towards the outside, that is, through the base, as well as to the anode and to the connection terminals of the housing 102 are, respectively, shown at reference numbers 127, 128.

Various changes and modifications may be made and any features disclosed herein with respect to any one of the embodiments may be used with any of the others, within the scope of the invention concept.

A prior art lamp, for example as illustrated in the above referred-to German 39 08 553 C1, Thomas et al., in comparison to a lamp in accordance with the present invention, shows the following:

| Operating Voltage<br>Anode Cathode<br>Radiation Output | Prior Art Lamp | This Invention<br>FIG. 1<br>(collectively) |
|---|---|---|
| Operating voltage | 65–110 V | 65–110 V |
| Spectral Radiance | 35–70 $\mu$W | 60–150 $\mu$W |
| at 215 nm | $mm^2$ SR nm | $m^2$ SR nm |

SR stands for "steradian", which is defined as the solid angle having an apex at the center of a sphere, and which describes on the surface of the sphere, an area equal to that of a square having at its side the radius of the sphere. Spectral radiant density has the dimension ($mW/mm^2$ sr nm).

I claim:

1. A discharge lamp having a bulb of quartz glass or high silicate glass;

a fill within the bulb of at least one of deuterium, hydrogen, mercury, a metal halide, a noble gas;

a support structure (2) within the bulb;

an anode (3) and a cathode (4) supported by said support structure (2);

a diaphragm means of high temperature resistance, high melting point material having an aperture therein, which aperture, together with the anode, defines a radiation axis (5), wherein the cathode (4) is located laterally offset with respect to said radiation axis (5), said diaphragm means, in operation of the lamp, constricting a radiation discharge between the cathode (4) and the anode (3), and wherein, in accordance with the invention, said diaphragm means comprises at least two apertured diaphragm elements for constricting said radiation discharge along said axis (5), wherein the diaphragm elements along the longitudinal direction of said axis, have a thickness dimension of at least 0.3 mm;

and wherein the diaphragm elements are connected to electrical potentials to form controllable auxiliary electrodes.

2. The lamp of claim 1, wherein said diaphragm elements are made of sheet metal, each with a thickness of at least 0.03 mm, and wherein the apertures of the diaphragm elements are spaced from each other by at least 0.1 mm.

3. The lamp of claim 2, wherein the diameters of the apertures (10, 11, 12) of the diaphragm elements (6, 7, 8) are between about 0.1 to 2 mm.

4. The lamp of claim 2, wherein the diaphragm elements have a thickness of between about 0.1 and 1 mm, and the spacing of the apertures (10, 11, 12) of the diaphragm elements (5, 6, 7) is between about 0.1 and 5 mm.

5. The lamp of claim 4, wherein the spacing of the diaphragm elements (6, 7, 8) is about 0.3 mm.

6. The lamp of claim 3, wherein three diaphragm elements (6, 7, 8) are provided.

7. The lamp of claim 2, wherein said diaphragm elements (6, 7, 8) comprise tungsten, molybdenum, or a high melting point ceramic.

8. The lamp of claim 2, wherein said diaphragm elements (6, 7, 8) are electrically insulated with respect to each other.

9. The lamp of claim 2, further comprising ring-shaped spacers (34, 35) located between adjacent diaphragm elements (6, 7, 8), said spacers comprising ceramic material.

10. The lamp of claim 2, further comprising ring-shaped spacers (34, 35) located between adjacent diaphragm elements (6, 7, 8), said spacers (34, 35) having an electrically insulating surface.

11. The lamp of claim 9, wherein said spacers (34, 35) comprise electrical resistance elements.

12. The lamp of claim 9, wherein said ceramic material of the spacers has an electrically conductive resistance layer coating applied thereto.

13. The lamp of claim 2, including electrical resistors (17, 18, 19) electrically connecting the diaphragm elements (6, 7, 8) and supplying said controlled electrical potentials; and wherein that one diaphragm element (6) which is closest to the anode (3) is electrically connected to the anode through one (17) of said resistors, and said anode is connected to a positive terminal (46) of an electrical energy supply (44) for the anode and cathode (3, 4).

14. The lamp of claim 2, further comprising a plurality of controlled switches (36, 37, 38, 39) connected for selectively connecting the anode (3) and said diaphragm elements (6, 7, 8) with a positive terminal (46) of an electrical energy supply source (44) for the cathode (4) and the anode (3) to provide said controlled electrical potentials.

15. A discharge lamp having a bulb of quartz glass or high silicate glass; p1 a fill within the bulb of at least one of deuterium, hydrogen, mercury, a metal halide, a noble gas;

a support structure (2) within the bulb;

an anode (3) and a cathode (4) supported by said support structure (2);

a diaphragm means of high temperature resistance, high melting point material having an aperture therein, which aperture, together with the anode, defines a radiation axis (105), wherein the cathode (4) is located laterally offset with respect to said radiation axis (105), said diaphragm means, in operation of the lamp, constricting a radiation discharge between the cathode (4) and the anode (3), and wherein, in accordance with the invention, said diaphragm means comprises an apertured diaphragm element (109) constricting said radiation discharge along said axis (105) which has a thickness dimension along the longitudinal direction of said axis (105) of between 1 and 50 mm, and wherein the diaphragm element is connected to an electrical potential to form a controllable auxiliary electrode.

16. The lamp of claim 15, wherein the diameter of the diaphragm opening (113) of said diaphragm element (109) is between about 0.1 and 2 mm.

17. The lamp of claim 15, wherein said diaphragm element (109) comprises tungsten or molybdenum.

18. The lamp of claim 15, wherein said diaphragm element (109) comprises a high melting point ceramic and an electrically conductive surface applied to said high melting point ceramic diaphragm element (109), said conductive surface being controllably connected to said electrical potential.

19. The lamp of claim 15, wherein the spacing of said diaphragm element from the anode is between about 0.5 and 2 mm.

20. The lamp of claim 15, wherein said diaphragm element (109) has a thickness of between about 1 and 5 mm.

* * * * *